US005343532A

United States Patent [19]

Shugart, III

[11] Patent Number: 5,343,532

[45] Date of Patent: Aug. 30, 1994

[54] HEARING AID DEVICE

[76] Inventor: M. Wilbert Shugart, III, P.O. Box 892, Yadkinville, N.C. 27055

[21] Appl. No.: 848,320

[22] Filed: Mar. 9, 1992

[51] Int. Cl.[5] ..... H04R 25/00

[52] U.S. Cl. ..... 381/68.6; 381/68; 381/69

[58] Field of Search ..... 381/68.6, 68, 68.5, 381/68.3, 69.2, 69

[56] References Cited

U.S. PATENT DOCUMENTS

| | | | |
|---|---|---|---|
| 2,485,405 | 10/1949 | Olney et al. | 381/150 |
| 3,209,081 | 9/1965 | Ducote et al. | 600/25 |
| 3,894,195 | 7/1975 | Kryter | 179/107 FD |
| 4,259,547 | 3/1981 | Valley et al. | 179/1 B |
| 4,334,315 | 6/1982 | Ono et al. | 455/11 |
| 4,340,972 | 7/1982 | Heist | 455/39 |
| 4,379,088 | 4/1983 | Mattatall | 381/69.2 |
| 4,379,988 | 4/1983 | Mattatall | 320/4 |
| 4,472,603 | 9/1984 | Berg | 179/107 R |
| 4,539,440 | 9/1985 | Sciarra | 381/68 |
| 4,742,887 | 5/1988 | Yamagishi | 181/129 |
| 4,777,474 | 10/1988 | Clayton | 340/539 |
| 4,790,019 | 12/1988 | Hueber | 381/68.4 |
| 4,890,330 | 12/1989 | Meyer | 381/69.2 |
| 4,918,736 | 4/1990 | Bordewijk | 381/68 |
| 4,918,737 | 4/1990 | Luethi | 381/68.4 |
| 4,920,570 | 4/1990 | West et al. | 381/68 |
| 5,031,219 | 7/1991 | Ward et al. | 381/68.6 |
| 5,172,346 | 12/1992 | Wagner et al. | 381/68 |

FOREIGN PATENT DOCUMENTS

| | | | |
|---|---|---|---|
| 3826294 | 2/1990 | Fed. Rep. of Germany | 381/68 |

OTHER PUBLICATIONS

*Science*, vol. 253, dated Jul. 5, 1991 Article entitled "Human Ultrasonic Speech Perception".

*Winston-Salem Journal*, dated Jul. 6, 1991 Article entitled "Research Holds New Hope for the Deaf".

*Primary Examiner*—Curtis Kuntz

*Assistant Examiner*—Sinh Tran

[57] ABSTRACT

A device is designed to provide persons with a mild, moderate, severe or profound hearing loss the ability to hear sound that would be inaudible, as well as the ability to hear ambient environmental noise. The device is fabricated as: (1) a receiver assembly having a pliable flexible strip worn in the outer ear with a small transducer which extends into the auditory canal, and (2) a transmitter assembly having a microphone located remotely on the person whereby information is transmitted to the receiver assembly via modulated carrier waves. The need for a battery in the receiver assembly is eliminated as the power supply is driven by magnetic induction from the transmitter assembly positioned a few inches away, as in a neck pendant.

13 Claims, 4 Drawing Sheets

HEARING AID DEVICE

BACKGROUND OF THE INVENTION

1. Field of the Invention

The invention herein pertains to devices for assisting the hearing impaired and particularly to devices having an in-ear component and a remote microphone worn on the person.

2. Description of the Prior Art and Objectives of the Invention

One-piece prior art devices to assist the hearing impaired are usually worn in or about the ear and consist of a microphone to receive audible sound, an amplifier which amplifies the sound and a transducer which delivers the sound to the user's ear. A molded plug device generally reduces the opportunity for perception of natural sound. Acoustic coupling between the microphone and the transducer results in squealing or feedback when operated at the high amplification levels required for individuals with mild or greater hearing impairments. Prior in-ear devices require frequent and difficult battery replacement.

The typical molded hearing aid plug presents a significant restriction to the natural sounds of ambient environmental sound since it substantially closes the ear canal. Without regard to the degree of hearing loss an individual may suffer, the individual's ability to detect the direction of ambient sound is very important for proper sound sensing.

Also, conventional hearing aids are usually made to fit a particular wearer's ear and are not generally pliable, oftentimes causing discomfort and becoming loose during wear. Such hearing aids can also retain ear wax, causing a loss of performance and requiring frequent replacement and maintenance.

In view of the problems and disadvantages with known hearing aids, it is one objective of the present invention to provide a two (2) component hearing aid which includes: (1) a pliable ear receiver and (2) a wireless remote transmitter worn on the person.

It is another objective of the invention to provide an "in-ear" receiver which will not block ambient environmental sound from passing through the auditory canal, thereby enhancing the user's ability to detect the direction of ambient sound at greater distances.

It is still another objective of the invention to provide a small, lightweight transmitter which allows the user to adjust the gain of the received signal.

It is yet another objective of the invention to provide a feature in the form of a frequency change in the test tone of the transmitter if the battery becomes weak in the transmitter.

Various other objectives and advantages of the invention will become apparent to those skilled in the art as the more detailed presentation below is reviewed.

SUMMARY OF THE INVENTION

The hearing aid device of the invention allows the user to hear ambient environmental sounds while amplifying those sounds that would normally be inaudible. This is accomplished by an in-ear component which leaves the auditory canal unblocked while allowing a transducer to be placed in the ear canal. This invention is very beneficial in situations where the user may need to be alerted to impending danger signals, such as automobile horns or warning sirens, while allowing the user to be able to determine the direction of such ambient environmental sounds to the extent that the user is able. Use of the invention is not restricted to individuals with hearing impairments as it has applications in situations where an individual requires amplified sound from a particular source while maintaining an awareness of normal ambient environmental sounds.

The invention includes a microphone and a modulated carrier wave transmitter assembly which is remotely located from the ear but on the body of the user, as a piece of jewelry or necklace for example. Also included is a modulated carrier wave receiver assembly, consisting of a receiver, amplifier and transducer which is in a pliable housing for wearing in the outer ear.

DESCRIPTION OF THE PREFERRED EMBODIMENT

The transmitter assembly of the invention includes a microphone and transmitter which is remotely located on the person relative to the receiver assembly to reduce or eliminate the possibility of an undesirable acoustic coupling or feedback by virtue of acoustic losses resulting from the distance separating the microphone from the transducer in the receiver assembly.

In the case of a user with a hearing impairment in both ears, said transmitter assembly consists of two (2) microphones and transmitters designed to be directional in their ability to detect audible sound. The transmitter assembly includes controls which allow the user to adjust the amplitude of the received signal. In the case of a dual hearing aid system, the amplitudes are individually adjustable. Frequency response tailoring is also achieved in the transmitter assembly which is powered by a nickel cadmium battery and includes a visual low battery indicator. Also included is a test mode which transmits a tone of preset level and frequency to the apparatus worn in or near the ear of the user. A change of frequency and level in this tone is designed to warn the user of impending battery failure and resulting distortion of the audio output of the apparatus worn in or near the ear. Also included is a modulated carrier wave transmitter of the type acceptable under Part 15 of the Federal Communications Commission Rules and Regulations for operation in the ultra high frequency spectrum, to significantly reduce or eliminate the possibility of interference from outside sources.

A second component of the invention consists of a receiver assembly designed to be worn in the outer ear area with a transducer attached and extending into the auditory canal. The receiver assembly is designed to be pliable, in the shape of a ribbon, and which can be manually formed or molded to fit the curvature of the inside area of a particular wearer's outer ear. Said receiver assembly is encased in a flexible polymeric housing having a relatively easily pliable wire of suitable diameter to provide structural strength. The transducer is encased in a small diameter tube attached to the receiver housing so it will not block the auditory canal.

The receiver assembly is powered by a DC voltage resulting from interaction with a magnetic field generated by the transmitting device.

The receiver assembly which includes a receiver, amplifier and transducer are all enclosed in a thin, planar pliable plastic housing which facilitates cleaning by the user.

The invention herein may also be used with a conventional bicross hearing aid (as is known in the industry) to help improve the hearing of those with only one healthy ear.

DETAILED DESCRIPTION OF THE DRAWINGS AND OPERATION OF THE INVENTION

Figure 1:
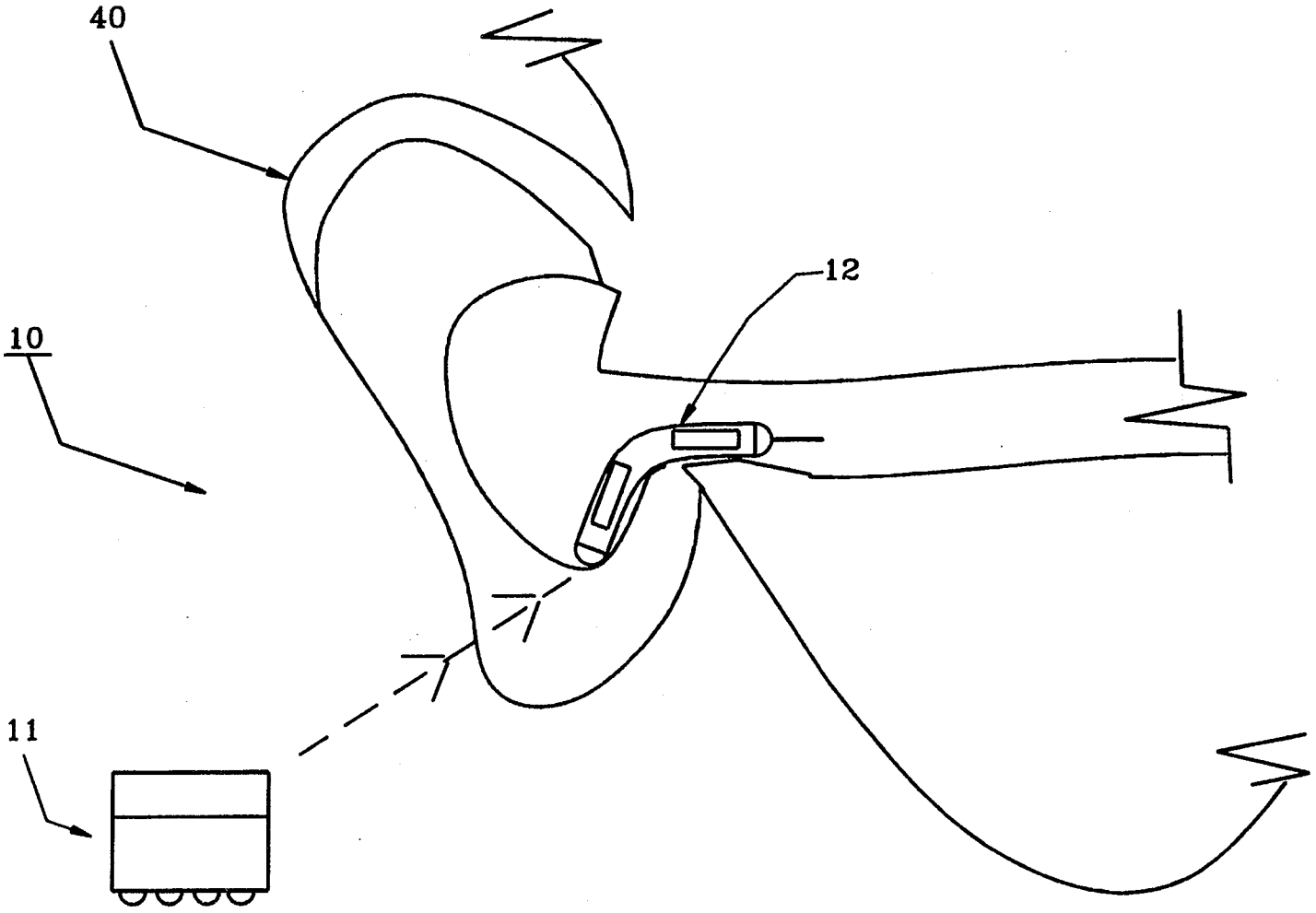
FIG. 1 shows the ear receiver assembly of the invention as placed in a typical human ear with the remote transmitter assembly nearby as worn on the person.
Figure 2:
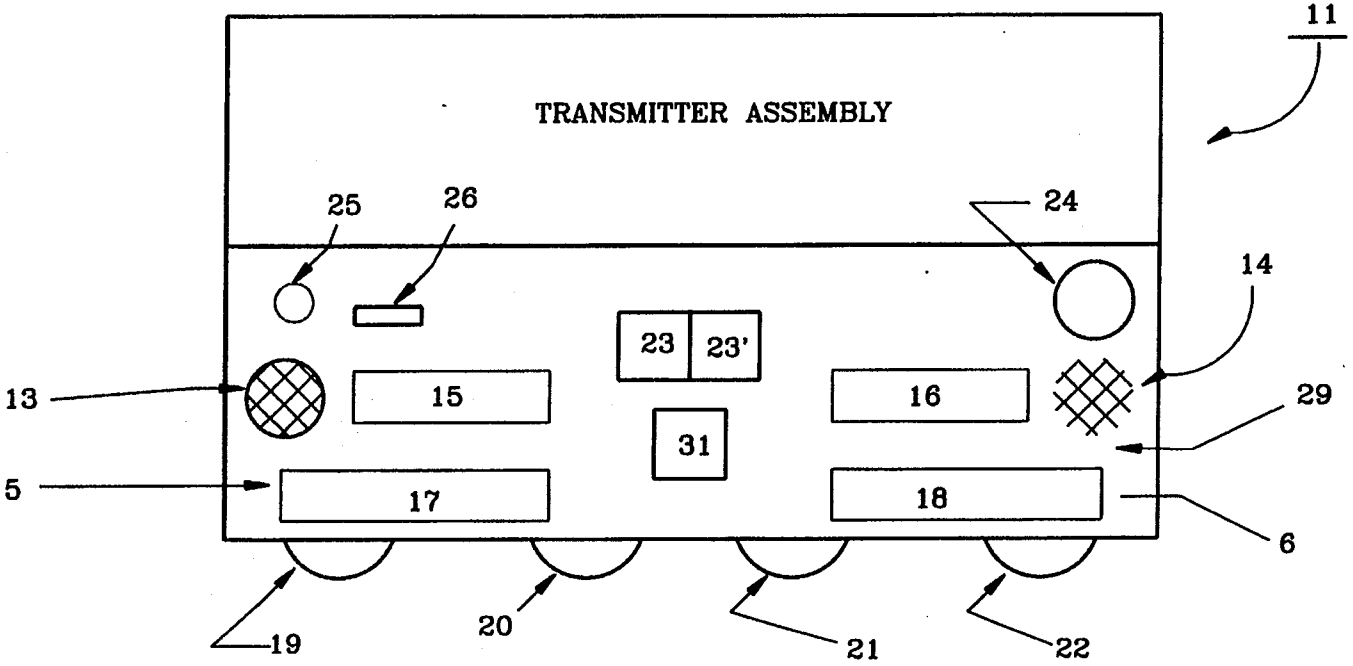
FIG. 2 illustrates a close-up view of the transmitter assembly of the invention.
Figure 5:
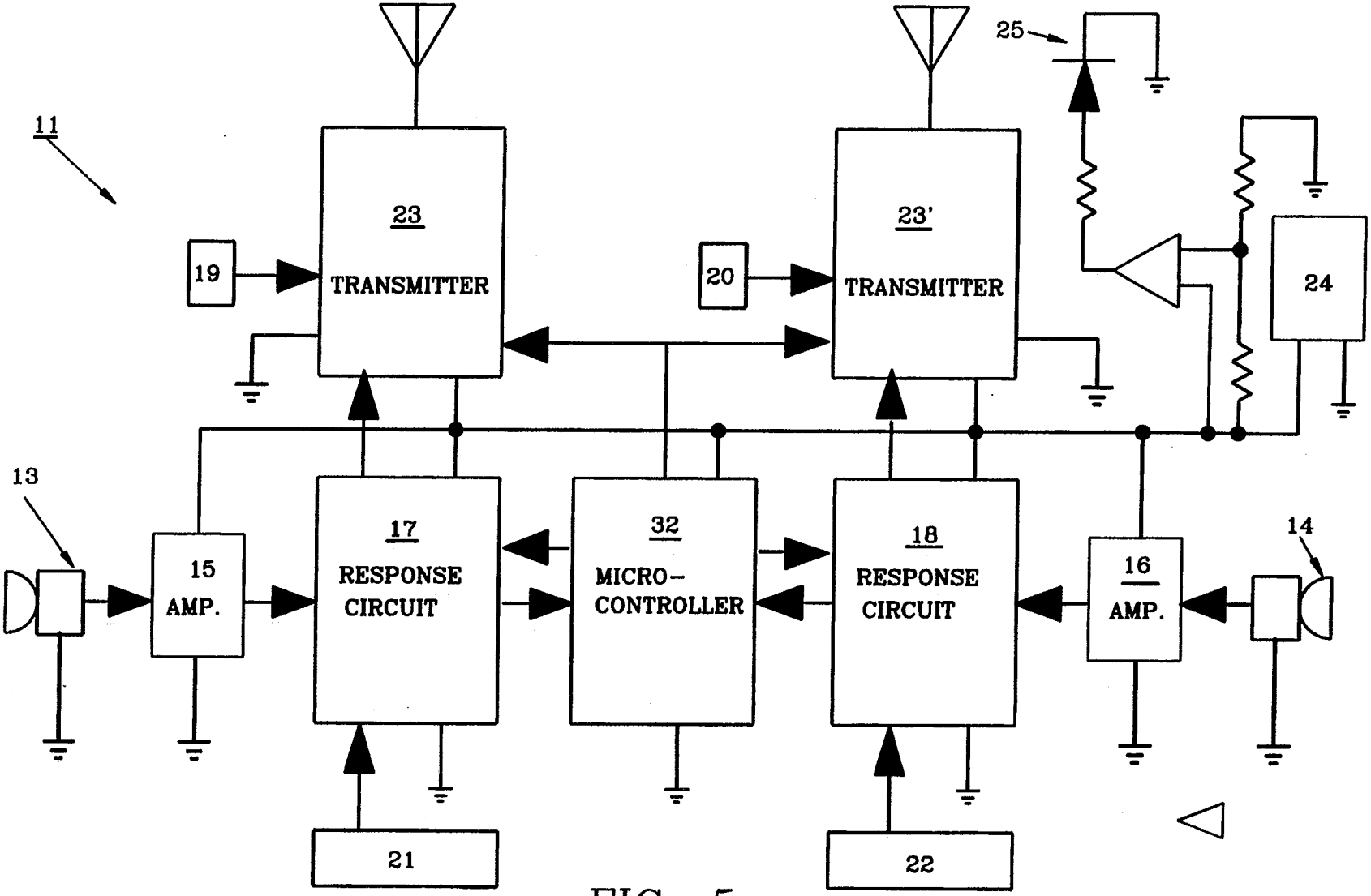
FIG. 5 shows circuitry in block form of the transmitter assembly.

For a more complete understanding of the invention and its operation, hearing device 10 is shown in FIG. 1 with transmitter assembly 11 positioned remotely from receiver assembly 12 which is in place in ear 40. Transmitter assembly 11 consists as seen in FIGS. 2 and 5 of a left channel microphone 13 and a right channel microphone 14 for relaying audio information through circuitry (FIG. 5) to the left channel amplifier 15 and the right channel amplifier 16 respectively. These circuits in turn communicate with left channel level and frequency response circuit 17 and right channel level and frequency response circuit 18 and microcontroller 32. In circuits 17 and 18 the audio response is tailored to fit the individual user. Left channel gain control 19 and right channel gain control 20 are utilized to allow the user independent control of the gain of each channel. Likewise, left channel tone control 21 and right channel tone control 22 are utilized to allow the user independent control of the response characteristics of each channel. The output of level and frequency response circuits 17 and 18 are fed respectively to transmitters 23, 23'. In transmitters 23, 23', the channels are combined in a standard multiplexed frequency modulated carrier wave output.

Rechargeable battery 24 in transmitter assembly housing 29 (which may be formed from a durable plastic) drives assembly 11. An alternate means to drive assembly 11 may include magnetic induction. The condition of rechargeable battery 24 is monitored by a low battery indicator or comparator 25 which may be monitored or controlled by microcontroller 32. A spare battery can be kept in battery storage compartment 31 as also seen in FIG. 2.

Transmitter assembly 11 is designed to be worn on the person, perhaps as jewelry. For example, a neck pendant would house the transmitter circuitry with an attached necklace comprising the antenna. Dimensions may be approximately 100×100×10 mm for transmitter assembly 11 but could take the form of a personal accessory, and made smaller such as a watch or pendant replica. It is important that left channel microphone 13 and right channel microphone 14 be of a directional nature, to improve the user's ability to sense direction with respect to the source of the audible sound received.

Figure 3:
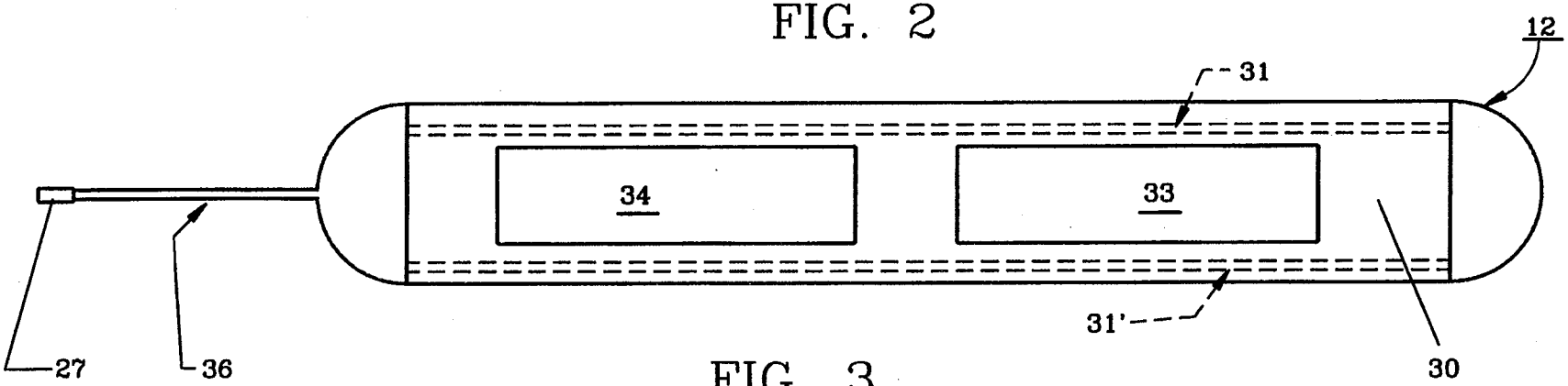
FIG. 3 depicts a close-up view of the receiver assembly removed from the ear.
Figure 4:
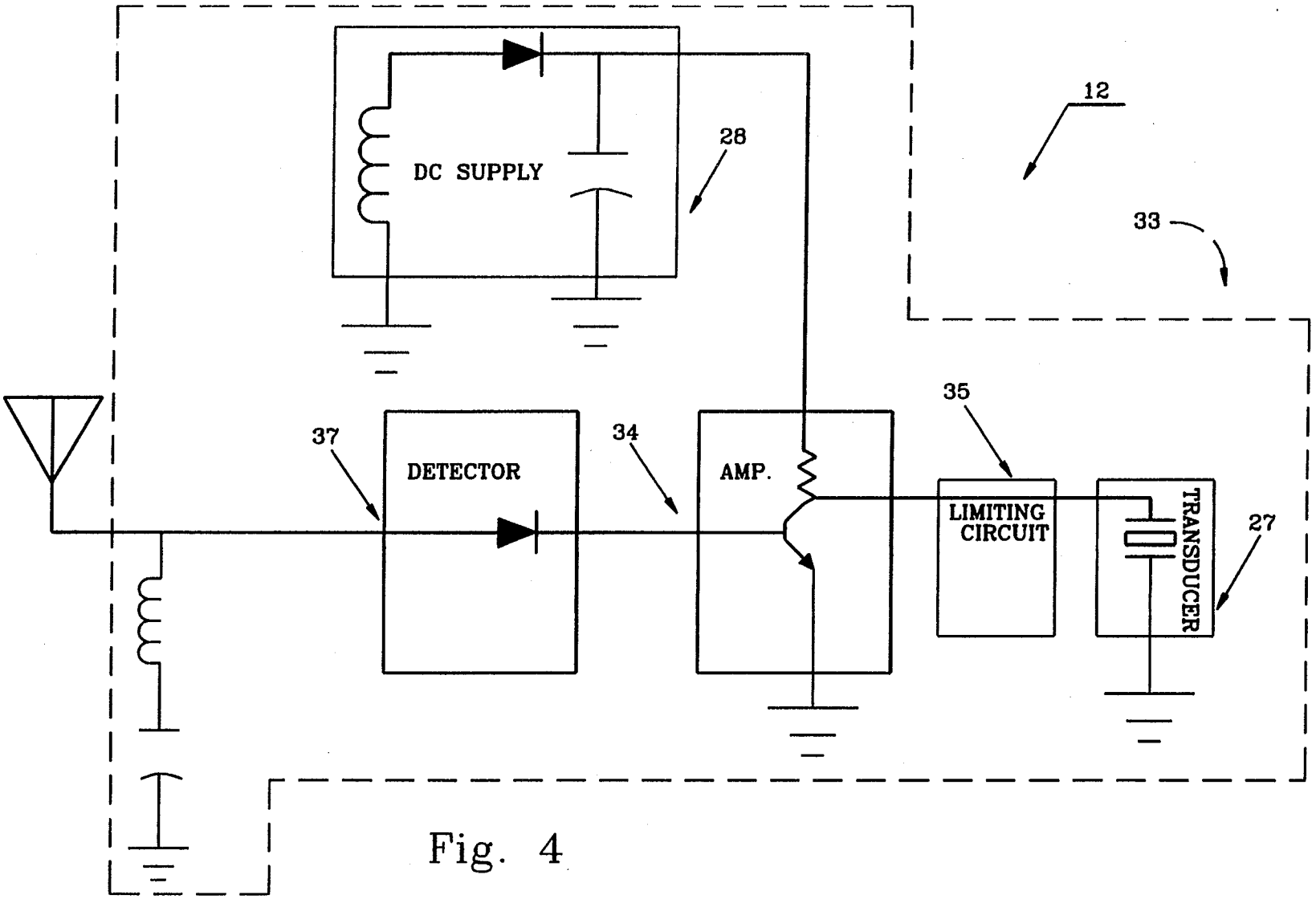
FIG. 4 demonstrates circuitry in block form of the receiver assembly of the invention.

As shown in FIG. 3, receiver assembly 12 is constructed with a flexible polymeric housing 30, such as polyvinyl chloride or other suitable materials which allows assembly 12 to be molded or deformed to the curvature of the user's outer ear as shown in FIG. 1. Assembly 12 is designed to be adjusted by the user to satisfy specific needs for comfort and may be for example approximately 50 mm in length, 10 mm wide and 3 mm thick for an average adult male. Bendable wires 31, 31' are positioned longitudinally in housing 30 to maintain the desired shape upon deforming. Receiver assembly 12 as seen in FIG. 4 includes receiver 33 which is designed to intercept and demodulate the multiplexed frequency modulated signal from transmitter assembly 11. Receiver assembly 12 is designed to demodulate either the right or left channel information. A received signal is sent to amplifier 34 which provides the required level to drive transducer 27. Conventional limiting circuit 35 is included to reduce the possibility of hearing damage as a result of an unexpected loud impulse (noise). Transducer 27 is affixed on a flexible stem 36 which allows its location to be adjusted by the user in the auditory canal by bending stem 36. DC supply 28 (FIG. 4) is driven by magnetic induction and eliminates the need for a battery in receiver assembly 12. Detector 37 allows only frequency specific signals to pass to amplifier 34 as detector 37 comprises a tuned diode. Receiver assembly 12 may be activated by transmitter assembly 11 housed within a pendant worn around the neck whereby only a few inches (6–10) separate transmitter assembly 11 and receiver assembly 12. Thus, magnetic induction provided by transmitter assembly 11 will drive DC supply 28 of receiver assembly 12 and will thus eliminate the need for a battery in receiver assembly 12.

All circuitry for assembly 12 is manufactured on conventional thin flexible printed circuit stock to allow the unit to be easily shaped by manual pressure to conform to the user's outer ear area. Wires 31, 31' are imbedded in flexible plastic housing 30 as required to provide structural strength and may be formed from steel, aluminum or certain plastics. Values for the particular circuit components are to be matched as would be understood by those skilled in the art for the most convenience, cost and operating efficiency.

The illustrations and examples provided herein are for explanatory purposes and are not intended to limit the scope of the appended claims.

I claim:

1. A hearing aid device comprising in combination:

(a) a transmitter assembly, said transmitter assembly for detecting audible sounds, and (b) a receiver assembly, said receiver assembly in remote communication with said transmitter assembly, said receiver assembly comprising a pliable housing, a transducer, a bendable wire, said bendable wire embedded in said housing and said transducer attached to said pliable housing, said receiver assembly positionable in the outer ear of the wearer with the transducer within the auditory canal whereby said auditory canal is substantially open and unblocked.

2. The hearing aid device of claim 1 wherein said receiver assembly is configured in a thin ribbon-like shape.

3. The hearing aid device of claim 1 wherein said receiver assembly further comprises: a receiver, said receiver comprising an amplifier.

4. The hearing aid device of claim 3 and including a limiting circuit, said limiting circuit to limit the effect and damage of a sudden, loud noise, said limiting circuit connected to said receiver.

5. The hearing aid device of claim 3 and including a power source, said power source being responsive to magnetic induction, said power source connected to said amplifier.

6. The hearing aid device of claim 1 wherein said transmitter assembly comprises a microphone, an amplifier, said microphone is communication with said amplifier, a transmitter, said amplifier connected to said transmitter, a frequency response circuit, said frequency response circuit connected to said amplifier, whereby sounds detected by said microphone are transmitted by said transmitter to said receiver assembly.

7. The hearing aid device of claim 6 and including a transmitter assembly housing, a spare battery storage compartment, said battery storage compartment positioned within said transmitter assembly housing.

8. The hearing aid device of claim 6 and including left and right gain controls, said gain controls connected to said frequency response circuit.

9. The hearing aid device of claim 1 wherein said transmitter assembly comprises: a transmitter, a left microphone, a left amplifier, a left frequency response circuit, said left microphone, left amplifier and left frequency response circuit all connected to sad transmitter, a right microphone, a right amplifier, a right frequency response circuit, said right microphone, right amplifier and right frequency response circuit all connected to said transmitter.

10. The hearing aid comprising: a signal receiver assembly, said signal receiver assembly including a flexible housing, a flexible stem, said stem extending from said housing, a transducer, said transducer positioned in said stem, a bendable wire, said bendable wire embedded in said flexible housing, said receiver assembly positionable in the outer ear of the wearer with the transducer within the auditory canal to thereby leave the auditory canal substantially open.

11. A hearing aid device including a transmitter assembly for detecting audible sounds, and a receiver assembly placed in the outer ear of the wearer with the transducer within the auditory canal for reception of signals from said transmitter assembly, the improvement comprising: said receiver assembly having a width along its entire length less than the diameter of the auditory canal whereby said auditory canal is substantially open and unblocked to allow environmental sounds to pass unopposed completely therethrough.

12. The hearing aid device of claim 11 wherein said receiver assembly comprises a pliable housing.

13. The hearing aid device of claim 12 and including a bendable wire, said bendable wire embedded in said pliable housing.

* * * * *